United States Patent [19]

Geer

[11] 4,421,127

[45] Dec. 20, 1983

[54] COMPACT CASE WITH INTERCHANGEABLE COSMETIC INSERTS

[76] Inventor: Marjorie Geer, 2429 Ridge Road Dr., Alexandria, Va. 22302

[21] Appl. No.: 420,367

[22] Filed: Sep. 20, 1982

[51] Int. Cl.[3] ..... A45D 33/00

[52] U.S. Cl. ..... 132/83 R

[58] Field of Search ..... 132/83 R, 79; 312/227

[56] References Cited

U.S. PATENT DOCUMENTS

| | | | |
|---|---|---|---|
| 1,715,820 | 6/1929 | Deitel | 132/83 R |
| 2,031,933 | 2/1936 | Clegg | 132/83 R |
| 3,637,278 | 1/1972 | Easterbrooks | 132/83 R |
| 4,337,859 | 7/1982 | Murphy | 132/83 R |

*Primary Examiner*—Gregory E. McNeill

*Attorney, Agent, or Firm*—Cushman, Darby & Cushman

[57] ABSTRACT

A compact case includes a top cover, a bottom support tray, and an intermediate lid positioned between the top cover and support tray, all being hinged together for relative movement with respect to one another, the support tray including a matrix configuration of ribs defining areas to accept the cosmetic inserts while the lid defines openings corresponding to the matrix configuration. The cosmetic inserts contain cosmetic materials and are removably positioned in selected ones of the areas and include a base defining a perimetrical edge of proper dimension and geometric shape corresponding to the selected area and an upstanding neck member interiorly disposed relative the perimetrical edge to define a circumferential horizontal ledge. The openings in the lid register with the neck members and their associated ledges to restrain the cosmetic inserts in the compact case.

15 Claims, 7 Drawing Figures

FIGURE 4
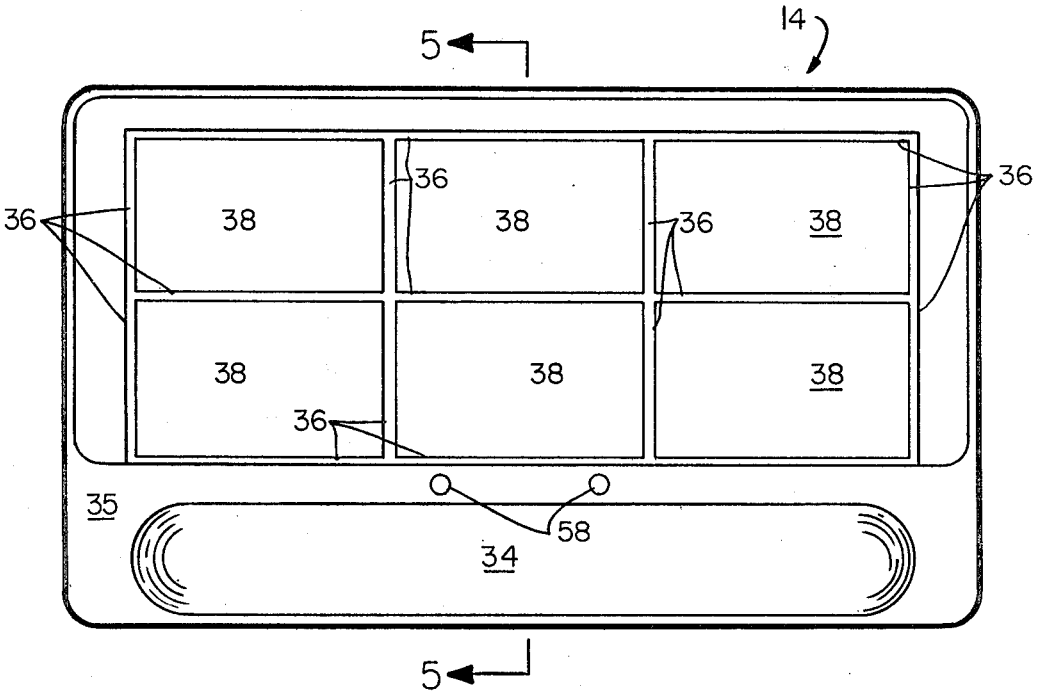
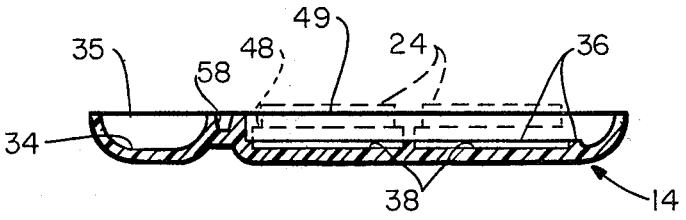
FIGURE 5

FIGURE 6
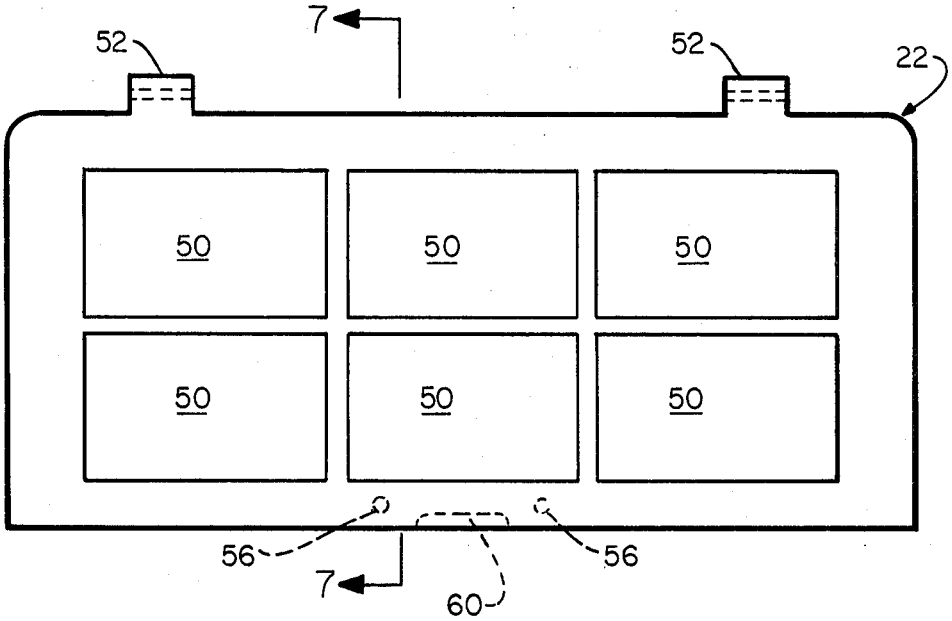
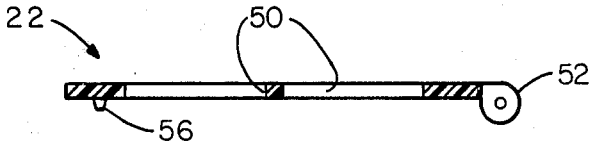
FIGURE 7

COMPACT CASE WITH INTERCHANGEABLE COSMETIC INSERTS

INTRODUCTION

The present invention generally relates to a novel and improved case for housing, in palette form, a plurality of individual cosmetic containers. A case of the type with which the present invention is concerned is generally recognized in the art as a "compact" case. More particularly, however, the present invention relates to an improved compact case wherein removable inserts, each containing a predetermined shade and/or type of cosmetic, can be securely held in place thereby providing the user with a variety of cosmetic materials from which to choose.

THE PRIOR ART

Prior to considering the distinctly advantageous and novel aspects of the present invention, the reader may wish at this time to refer to certain prior art proposals for cosmetic cases and the like.

Removable cosmetic containers are, in and of themselves, fairly well known in the relevant art area as evidenced by U.S. Pat. Nos. 1,767,567 to Weil and 1,851,462 to Steller. Furthermore, it has previously been proposed to circularly arrange individual removable cosmetic containers in a case wherein a wheel structure having a single opening is coaxially and rotatably supported above the circular arrangement so that individual cosmetics can be selectively addressed via the opening by movement of the wheel structure (see, U.S. Pat. Nos. 2,035,356 to White et al and 2,628,625 to Pike).

The reader may also wish to refer to the following U.S. patents to glean further background art information: U.S. Pat. Nos. 1,771,337 to Kendall; 2,233,859 to Wick; 2,365,143 to Emery; 2,823,681 to Miller; 2,851,041 to Grosso; 3,592,201 to Haddaway; 4,132,306 to Margolin; and D. 168,543 to Hardy.

BACKGROUND AND SUMMARY OF THE INVENTION

The reader will appreciate that cosmetic materials offered to the consumer are too numerous in variety to name each one separately herein. Suffice it to say, however, that the particular cosmetic assortment which an individual consumer purchases is entirely dependent upon that consumer's subjective preferences. The reader will also appreciate that a consumer normally desires an assortment of cosmetics which includes the desired color hues to accent and complement that consumer's particular skin, hair color, facial characteristics, or even, wardrobe. Additionally, various types of cosmetics may be desirable, for example, eye shadow, mascara, foundations, blush, lip gloss or the like.

Heretofore, when a consumer desired to purchase an assortment of cosmetics in a single package, manufacturers would often present a palette of preselected, fixed containers of cosmetic materials having a variety of both colors and types. However, as has been briefly noted, it was highly unlikely that each consumer would subjectively approve of the manufacturer's preselected assortment. Consequently, the consumer would use only those cosmetics which met with their approval and therefore would waste those cosmetics which did not. This, of course, was costly to the consumer since the unused and wasted cosmetics were purchased together with desired cosmetics.

My invention, therefore, is intended to alleviate such wasteful practices and to ensure that consumers will have at their disposal a complete array of desired cosmetics. To accomplish this advantageous result, I provide a cosmetic compact case wherein a matrix configuration is provided to accept a plurality of individual removable cosmetic inserts so as to establish a cosmetic palette. In order to securely hold the inserts in their predetermined matrix position, I provide a hinged locking intermediate lid which defines a plurality of openings corresponding in number and position to the matrix configuration. The openings register with corresponding ones of the inserts so as to restrain them from inadvertant movement inside the compact case while, at the same time, permitting free access to all cosmetics contained in each of the inserts comprising the matrix.

It is entirely conceivable, therefore, that the individual cosmetic inserts can be offered to the consumer independent of the compact case of the present invention into which they will be positioned. Thus, consumers will now be able to choose only those preferred cosmetics which are desirable for purchase and assemble them in a compact case so as to establish a personal and unique arrangement of cosmetics. Furthermore, the novel compact case of the present invention can be provided with any combination of desired matrix configurations so that the quantity and variety of cosmetics which a consumer can have in an organized fashion is limited only in a practical sense by the resulting size thereof.

Accordingly, the consumer can now own a variety of cosmetics enclosed in one container for home use, yet be able to select only those cosmetics for carrying in a pocket or purse by removing the desired cosmetics inserts from the larger home-use case and placing them in a smaller, more portable version of the case. In each instance, the cosmetic inserts are identical in size and geometric configuration thereby promoting free interchangeability and versatility among compact cases having various matrix arrangements.

These and other advantages of the present invention will become more clear to the reader after careful consideration is given to the detailed description of the preferred exemplary embodiment thereof which follows.

BRIEF DESCRIPTION OF THE ACCOMPANYING DRAWINGS

Reference will herein be made to the accompanying drawings depicting a preferred embodiment of my invention wherein like numerals throughout the various figures denote like structural elements, and wherein:

FIG. 4 is a top plan view of the bottom support tray of the FIG. 1 compact case;

FIG. 5 is a cross-sectional elevational view taken along line 5—5 in FIG. 4;

FIG. 6 is a top plan view of the intermediate lid of the FIG. 1 compact case; and FIG. 7 is a cross-sectional elevational view taken along line 7—7 in FIG. 6.

DETAILED DESCRIPTION OF THE PREFERRED EXEMPLARY EMBODIMENT

Figure 1:
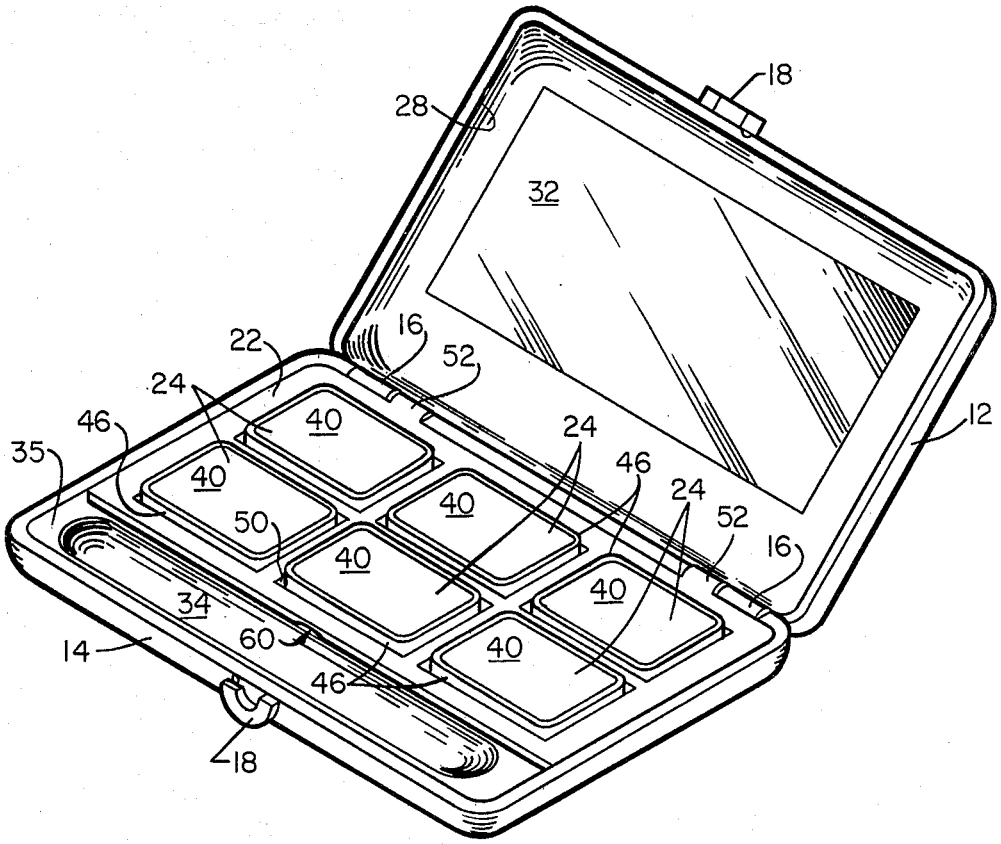
FIG. 1 is a perspective view of the compact case in accordance with the present invention depicted in an open state.
Figure 2:
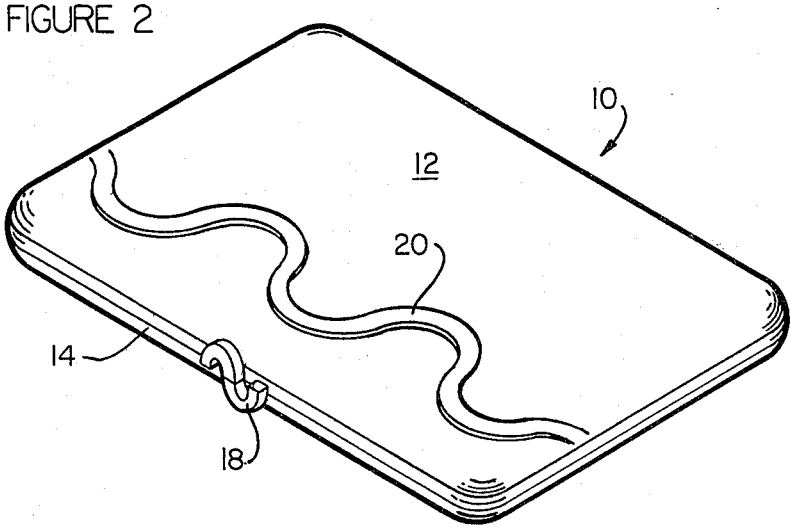
FIG. 2 is a perspective view of the FIG. 1 compact case depicted in a closed state.
Figure 3:
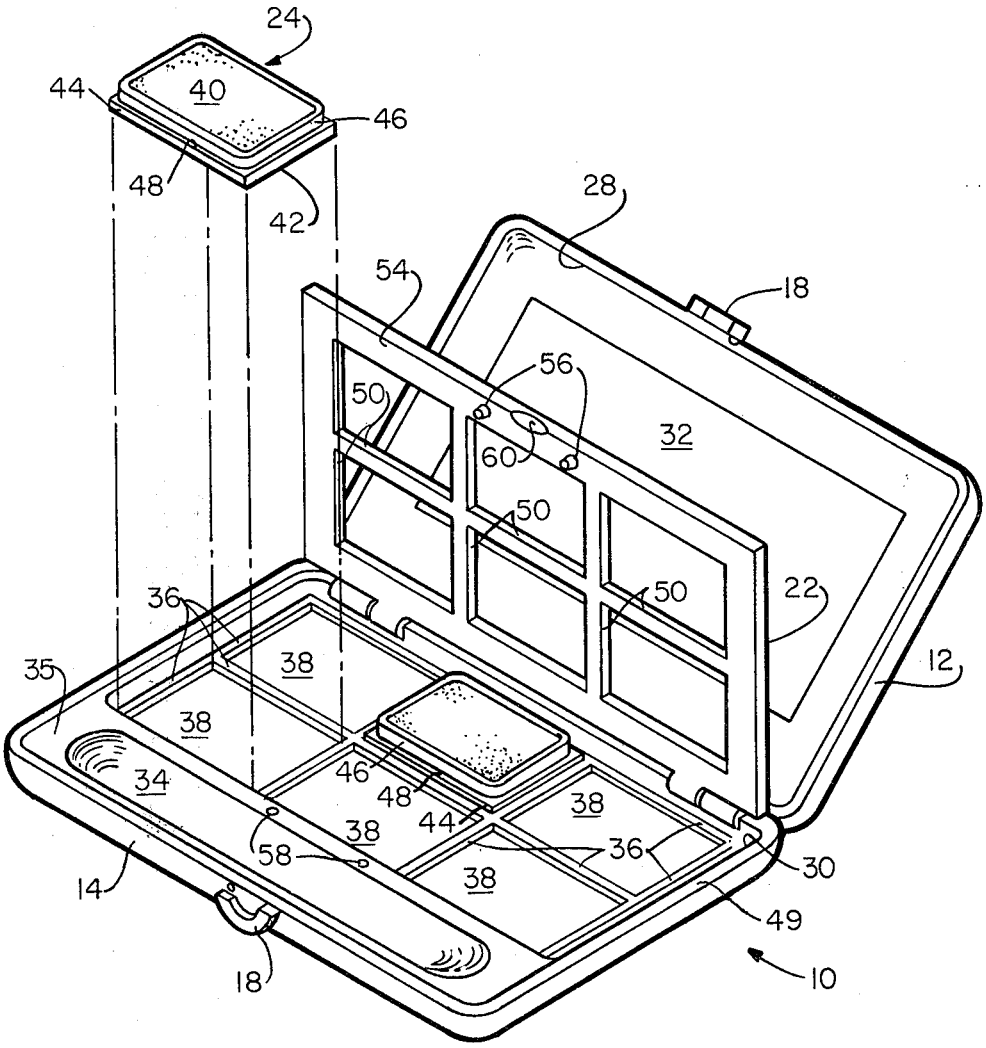
FIG. 3 is a perspective view of the FIG. 1 compact case depicting the intermediate lid in an open state and representative cosmetic inserts therein.

As depicted in the accompanying drawings with particular attention being directed to FIGS. 1-3, it is seen that the compact case 10 of the present invention generally includes a top cover 12 and a bottom support tray 14 connected to one another for relative pivotal movement by suitable hinges 16. A clasp 18 or other releasable mechanisms can be provided to effect secure locking engagement of compact case 10 in a closed position (see FIG. 2), yet permit case 10 to be opened (see FIG. 1) so as to gain access to the cosmetics contained therein. To enhance the aesthetic appearance of compact case 10, a decorative design 20 can be engraved or embossed on the exterior portion thereof according to known techniques.

An important aspect of the present invention is the provision of an intermediate, substantially planar lid 22 which can be seen with more clarity by referring to FIGS. 3, 6 and 7. Lid 22 cooperates with the interchangeable cosmetic inserts 24 (only two representative cosmetic inserts being shown in FIG. 3 for ease of presentation) so as to restrain them from movement within case 10 yet permit predetermined ones to be replaced or interchanged as will be described in more detail below.

Top cover 12 and bottom support tray 14 each define on their inner surfaces a recess 28, 30, respectively, so that when case 10 is closed, a relatively shallow cavity is defined therein. Recess 28 can be provided with a mirror 32 to aid the user in applying the cosmetics housed in case 10. Furthermore, support tray 14 is preferably provided with a second recessed area 34 defined in forward surface 35 to conveniently hold cosmetic applicator brushes (not shown) or like utensils.

Support tray 14 is preferably integrally formed with upstanding ribs 36 disposed in recess 30 and upwardly projecting from the surface thereof (see FIGS. 4 and 5). Ribs 36 are arranged so as to define a predetermined matrix grid-like array of areas 38 into which the individual cosmetic inserts 24 are received.

Cosmetic inserts 24 are identical with respect to one another so as to promote free interchangeability thereof. A representative cosmetic insert 24 will now be described in more detail and particular attention is therefore directed to FIG. 3.

Cosmetic inserts 24 are provided so as to establish a receptacle of cosmetic material 40. Two representative cosmetic inserts 24 are depicted in FIG. 3, one being shown removed from its associated area 38 while the other being shown properly fitted in bottom support tray 14. Inserts 24, and thus areas 38 defined by ribs 36, can be any geometric shape, although I presently prefer a rectangular shape as shown in the accompanying drawings so as to maximize the available interior space of case 10.

Each cosmetic insert 24 includes an integral base 42 having a vertical perimetrical edge 44 dimensioned so as to closely fit against ribs 36 in areas 38. A neck member 46 (preferably integrally formed with base 42) is interiorly recessed from the perimetrical edge 44 so as to define a horizontal ledge 48 circumferentially extending around neck member 46, the purpose of which will become more clear from the discussion below. Furthermore, neck 46 defines a cavity into which a predetermined amount of cosmetic material 40 can be stored.

In order to securely restrain cosmetic inserts 24 within case 10, I provide lid 22, which has been briefly described above. Lid 22 defines a plurality of openings 50 and is preferably connected to top cover 12 and bottom support tray 14 via hinges 52 for relative independent hinged movement therewith. Preferably, hinges 52 and 16 are coaxially disposed relative to one another although opposing hinged connections to effect movement through opposing arcs is also conceivable. On the bottom surface 54 of lid 22 at the end generally opposite the hinged end, I provide a dependent pair of nibs 56 which cooperate with a corresponding pair of apertures 58 defined in surface 35 to permit a press-fitting closure of lid 22 (see FIG. 2). Of course, other locking means can be advantageously utilized. I prefer to provide lid 22 with a finger recess 60 to assist the user in opening lid 22 so as to replace or interchange cosmetic inserts 24 (e.g. as shown in FIG. 3).

Openings 50 are defined in lid 22 in such a manner that each registers with one cosmetic insert 24 positioned in areas 38 as hereinbefore described. When cosmetic inserts 24 are properly positioned in areas 38, ledge 48 is substantially coplanar with surface 35 and upper edge 49 of support tray 14 (see FIG. 5). Thus, neck members 46 of each insert 24 will pass through the associated opening 50 and extend a predetermined dimension above the upper surface 51 of lid 22. In such a manner, surface 54 bears against ledge 48 of each of the inserts 24 as well as surface 35 so as to maintain the spatial integrity of inserts 24 and restrain movement thereof. Of course, should the user desire to remove predetermined ones of cosmetic inserts 24, all that is necessary is that lid 22 be hingedly moved out of contacting relationship therewith as shown in FIG. 3.

As the reader will now undoubtedly realize, the present invention provides significant advantages over previously proposed compact cases. For example, complete interchangeability of cosmetic inserts is now available due to the present invention so as to permit the consumer to preselect only those cosmetics that are desired. Furthermore, a compact case in accordance with the present invention enables one to carry particular cosmetics on a daily basis even though such cosmetics are different from those utilized during the previous day.

The compact case with interchangeable cosmetic inserts of the present invention can be provided with any predetermined matrix or other configuration. Thus, although a square matrix configuration comprising two rows and three columns are shown in the accompanying drawings, other matrix configurations and permutations are contemplated (e.g. a one by one, one by three, four by four, etc.). Additionally, the areas defined by the ribs of the present invention can be of varied dimension and/or geometric shape with respect to one another although substantial identity thereamong is presently preferred.

The compact case and inserts of the present invention are preferably constructed of a lightweight, substantially rigid material e.g. thermoplastic materials, and can therefore be produced on a mass scale according to techniques well known in the product fabrication art.

Accordingly, while the present invention has been herein described in what is presently conceived to be the most preferred embodiment thereof, those in the relevant art may appreciate that many modifications may be made thereof without departing from the scope of the invention, which scope shall be accorded the broadest interpretation of the appended claims so as to encompass all equivalent structures, devices, and/or assemblies.

What I claim is:

1. A compact case for housing cosmetic material comprising in combination:

a top cover;

a bottom support tray including on the interior surface thereof a system of integral upstanding ribs defining a matrix configuration of areas each having predetermined dimensions and geometric shapes;

an intermediate lid having a top and bottom surface positioned between said top cover and said support tray and defining a matrix configuration of openings registrably corresponding to said matrix configuration of areas;

hinge means connecting said top cover, said support tray and said intermediate lid for relative hinged movement with respect to one another between open and closed positions, cosmetic containing means corresponding in number to said matrix configuration of areas, each of said cosmetic containing means including a base defining a perimetrical substantially vertrical edge having substantially the identical dimension and geometric shape of a selected one of said areas for close fitting relationship with said upstanding ribs defining said selected one, a neck member vertically extending above said base and positioned interiorly of said perimetrical edge thereby defining a horizontal ledge circumferentially surrounding said neck member, said neck member defining a cavity to accept and contain a pedetermined amount of cosmetic material therein, wherein each of said neck members registers with a predetermined one of said openings while a portion of the bottom surface of said lid presses against said ledge when said lid is in said closed position to restrain each of said cosmetic containing means in each of said selected ones of said areas.

2. A compact case adapted to retain individual cosmetic inserts of the type including a base defining a perimetrical substantially vertical edge having predetermined dimensions and geometric shape, a neck member vertically extending above said base and positioned interiorly of said perimetrical edge thereby defining a horizontal ledge circumferentially surrounding said neck member, said neck member defining a cavity to accept and contain a predetermined amount of cosmetic material therein, said compact case comprising in combination:

a top cover;

a bottom support tray including on the interior surface thereof a systm of integral upstanding ribs defining a matrix configuration of areas, each having predetermined dimensions and geometric shapes substantially corresponding to said perimetrical edge of selected ones of said cosmetic inserts so that said selected ones are removably received in said areas, said perimetrical edge being in close fitting relationship to said ribs;

an intermediate lid having top and bottom surfaces positioned between said top cover and said support tray and defining a matrix configuration of openings registrably corresponding to said matrix configuration of areas; and hinge means connecting said top cover, said support tray and said intermediate lid for relative hinged movement with respect to one another between open and closed positions; whereby said openings when said lid is in said closed position registers with associated one of said neck members while portions of said bottom surface bear against said ledges to restrain each of said cosmetic inserts in said areas.

3. A compact case as in claim 1 or 2 further comprising releasable locking means for releasably locking said lid and said support tray.

4. A compact case as in claim 1 or 2 further comprising closure means for releasably retaining said top cover and said bottom support tray in said closed position.

5. A compact case as in claim 4 wherein said bottom support tray further includes means defining recessed surfaces for accepting and retaining cosmetic applicators therein.

6. A compact case as in claim 3 wherein said locking means comprises at least one nib dependently and integrally formed on said bottom surface and an aperture defined in said bottom support tray cooperating with said nib to effect locking therebetween by press fitting said nib into said aperture.

7. A compact case as in claim 1 or 2 wherein said hinge means coaxially hinges said top cover, said bottom support tray and said lid together.

8. A compact case as in claim 1 or 2 wherein said top cover includes a mirror on the interior surface thereof.

9. A compact case as in claim 1 or 2 wherein a plurality of cosmetic containing means are provided.

10. A compact case as in claim 1 or 2 wherein said perimetrical edge defines a rectangular geometric shape.

11. A compact case as in claim 1 or 2 wherein said neck member is dimensioned in the vertical direction to pass through said opening and extends a predetermined dimension above said top surface of said lid.

12. A cosmetic insert containing a predetermined amount of cosmetric material and adapted to being removably placed in a compact case of the type comprising a top cover, a bottom support tray including on the interior surface thereof a system of integral upstanding ribs defining a matrix configuration of areas each having predetermined dimensions and geometric shapes, and intermediate lid having top and bottom surfaces positioned between said top cover and said support tray and defining a matrix configuration of openings registrably corresponding to said matrix configuration of areas, and hinge means connecting said top cover, said support tray and said lid for relative hinged movement with respect to one another between open and closed positions, said cosmetic insert including:

a base defining a perimetrical substantially vertical edge having substantially the identical dimension and geometric shape of a selected one of said areas for close fitting and removable relationship with said upstanding ribs defining said selected one;

a neck member vertically extending above said base and positioned interiorly of said perometrical edge thereby defining a horizontal ledge circumferentially surrounding said neck member; and means defining a cavity for accepting and containing a predetermined amount of cosmetic material therein, whereby said opening when said lid is in closed position registers with said neck member while portions of said bottom surface bear against said ledge to restrain said cosmetic insert in said selected one of said areas.

13. A cosmetic insert as in claim 12 wherein said neck member is dimensioned in the vertical direction to pass through said opening and extend a predetermined dimension above said top surface of said lid.

14. A cosmetic insert as in claim 12 or 13 wherein said perimetrical edge defines a rectangular geometric shape.

15. A cosmetic insert as in claim 11 wherein said neck is integrally formed with said base.

* * * * *